US005792982A

United States Patent [19]

Scheffee

[11] Patent Number: 5,792,982

[45] Date of Patent: Aug. 11, 1998

[54] TWO-PART IGNITER FOR GAS GENERATING COMPOSITIONS

[75] Inventor: Robert S. Scheffee, Lorton, Va.

[73] Assignee: Atlantic Research Corporation, Gainesville, Va.

[21] Appl. No.: 905,295

[22] Filed: Aug. 5, 1997

Related U.S. Application Data

[60] Continuation of Ser. No. 649,563, May 17, 1996, abandoned, which is a division of Ser. No. 966,928, Oct. 27, 1992, Pat. No. 5,542,688.

[51] Int. Cl.[6] ..... C06B 45/00

[52] U.S. Cl. ..... 149/2; 149/21; 102/202; 102/205

[58] Field of Search ..... 149/2, 19.4, 19.9, 149/21; 102/202, 205

[56] References Cited

U.S. PATENT DOCUMENTS

| | | | |
|---|---|---|---|
| H1144 | 3/1993 | Cherry et al. | 102/481 |
| 3,000,311 | 9/1961 | Stanley | 149/19.91 |
| 3,434,426 | 3/1969 | Dapper | 102/202 |
| 3,707,916 | 1/1973 | Meraz et al. | 60/256 |
| 3,827,715 | 8/1974 | Lynch | 149/2 |
| 3,862,866 | 1/1975 | Timmerman et al. | 149/21 |
| 4,166,045 | 8/1979 | Rudy et al. | 149/19.4 |
| 4,170,941 | 10/1979 | Reichard et al. | 102/202 |
| 4,269,120 | 5/1981 | Brede et al. | 102/202 |
| 4,358,998 | 11/1982 | Schneiter et al. | 102/202 |
| 4,391,196 | 7/1983 | Betts | 102/202 |
| 4,574,699 | 3/1986 | Bolieau | 102/205 |
| 4,658,578 | 4/1987 | Shaw | 149/19.4 |
| 4,892,037 | 1/1990 | Betts | 102/202 |
| 4,907,819 | 3/1990 | Cuevas | 280/736 |
| 5,005,486 | 4/1991 | Lenzen | 102/531 |
| 5,125,684 | 6/1992 | Cartwright | 280/736 |
| 5,380,380 | 1/1995 | Poole et al. | 149/22 |
| 5,385,098 | 1/1995 | Lindqvist | 102/205 |
| 5,427,030 | 6/1995 | Kidd et al. | 102/202 |
| 5,458,706 | 10/1995 | Finck et al. | 149/19.2 |
| 5,460,671 | 10/1995 | Khandhadia | 149/109.6 |
| 5,485,790 | 1/1996 | Hamilton et al. | 102/205 |
| 5,542,688 | 8/1996 | Scheffee | 280/741 |

*Primary Examiner*—Edward A. Miller

*Attorney, Agent, or Firm*—Sixbey Friedman Leedom & Ferguson; Frank P. Presta; Joseph S. Presta

[57] ABSTRACT

A two-part igniter for inflators used to inflate inflation devices such as air bags, lift rafts, slide chutes, and the like which includes a heterogeneous mixture of an ignition material and a consolidated mass of either i) a pyrotechnic component or ii) a composite propellant. The ignition material can be in a granular form or pelletized. The pyrotechnic component or composite propellant is provided as a pellet which is in immediate contact with the ignition material. The pyrotechnic component or composite propellant lowers the auto-ignition temperature of the two-part igniter. The two-part igniter can be used in inflators which generate all inflation gases from gas-generating compositions and in inflators which include a supply of stored pressurized inflation gases.

4 Claims, 1 Drawing Sheet

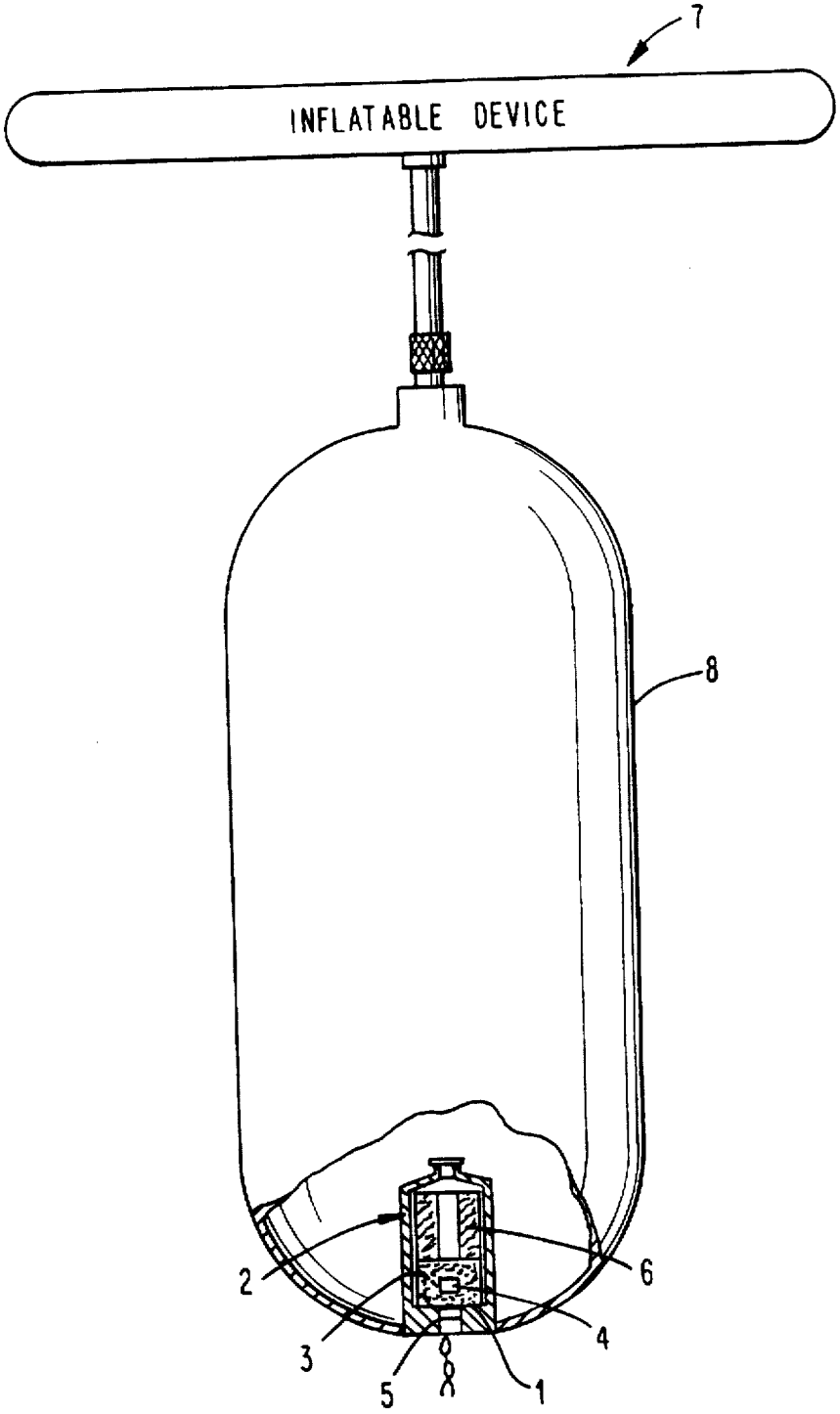
7
INFLATABLE DEVICE
8
2
6
3
4
5
1

TWO-PART IGNITER FOR GAS GENERATING COMPOSITIONS

This application is a continuation of application Ser. No. 08/649,563, filed May 17, 1996, now abandoned, which is a division of application Ser. No. 07/966,928 filed Oct. 27, 1992 now U.S. Pat. No. 5,542,688.

TECHNICAL FIELD

The present invention relates to inflators for devices such as protective passive restraints or "air bags" used in motor vehicles, escape slide chutes, life rafts, and the like. More particularly, the present invention relates to a two-part igniter for gas generating compositions used in inflators.

BACKGROUND ART

Many devices, such as protective passive restraints or "air bags" used in motor vehicles, escape slide chutes, life rafts, and the like, are normally stored in a deflated state and are inflated with gas at the time of need. Such devices are generally stored and used in close proximately to humans and, therefore must be designed with a high safety factor which is effective at all times.

Inflation is generally accomplished by means of a gas, such as air, nitrogen, carbon dioxide, helium, and the like which is stored under pressure and further pressurized and supplemented at the time of use by the addition of high temperature combustion gas products produced by the burning of a gas-generating composition. In some cases, the inflation gases are solely produced by gas-generating compositions.

It is obviously very important that the gas-generating composition be capable of safe and reliable storage without decomposition or ignition at normal temperatures which are likely to be encountered in a motor vehicle or other storage environment as, for example, up to temperatures as high as about 110° C. It is also important that substantially all of the combustion products generated during use be non-toxic, non-corrosive, and non-flammable, particularly where the device is used in a closed environment such as a passenger compartment of a motor vehicle.

Igniters for igniting gas generating compositions in inflators for protective passive restraints or "air bags" used in motor vehicles are known. Such igniters are themselves ignited by initiators, e.g., electric squibs, which are activated upon a sensed impact of the motor vehicle.

U.S. Pat. Nos. 4,561,675 to Adams et al and 4,858,951 to Lenzen disclose ignition devices for protective passive restraints or "air bags" in which the igniter and inflator are each contained in aluminum housings. As discussed in each of these patents, the use of aluminum has become prevalent in order to reduce weight. As further discussed in each of these patents, the use of aluminum housings has a disadvantage in that when exposed to high temperatures, such as those which might be encountered in a fire, the mechanical strength of the aluminum depreciates. In such instances when the auto-ignition temperature of the igniter is reached, the aluminum housings can rupture or burst, sending pieces and fragments flying in all directions.

In order to prevent serious damage which may result when igniters and/or gas generating compositions auto-ignite in heated aluminum housings, both U.S. Pat. Nos. 4,561,675 to Adams et al and 4,858,951 to Lenzen provide igniters which have a low auto-ignition temperature. Adams et al rely upon "intimate" thermal contact of the ignition material with the wall of the housing shell. Lenzen utilizes a homogeneous mixture of a booster material and an auto-ignition material which is a smokeless powder that ignites at a temperature in the range of 300° F. to 400° F.

Although the prior art has recognized and addressed the problem of dangerously high auto-ignition temperatures of igniters and/or gas generating compositions, presently known compositions which lower the auto-ignition temperatures disadvantageously suffer extensive weight loss over required storage temperatures, indicting thermal instability which can adversely affect the required performance of these materials.

DISCLOSURE OF THE INVENTION

It is accordingly one object of the present invention to provide an igniter for inflation devices which is storage stable over extended periods of time and temperature extremes.

Another object of the present invention is to provide a heterogeneous two-part igniter for inflation devices which has a safe auto-ignition temperature.

A further object of the present invention is to provide a two-part igniter for inflation devices which utilizes a single consolidated mass of a component which lowers the auto-ignition temperature of the two-part igniter.

It is an even further object of the present invention to provide inflation devices which incorporate the two-part igniter of the present invention.

A still further object of the present invention is to provide an improvement to existing inflators which involves the use of the present two-part igniter.

A still further object of the present invention is to provide a method of lowering the auto-ignition temperature of ignitor compositions.

According to these and other objects of the present invention which will become apparent as the description thereof proceeds hereafter, the present invention provides for a two-part igniter which includes a heterogeneous combination of:

an ignition material having an auto-ignition temperature, $T'_{ig}$; and a consolidated mass of a component which provides the two-part igniter with a lower auto-ignition temperature, $T_{ig}$ such that $T_{ig}$ is less than $T'_{ig}$.

The present invention further provides an inflator for an inflation device which includes a two-part igniter which is a heterogeneous combination of:

an ignition material having an auto-ignition temperature, $T'_{ig}$; and a consolidated mass of a component which provides the two-part igniter with a lower auto-ignition temperature, $T_{ig}$ such that $T_{ig}$ is less than $T'_{ig}$.

The present invention further provides a method of lowering the auto-ignition temperature of an igniter composition for inflation devices which involves providing the igniter composition with a consolidated mass of either i) a pyrotechnic component which lowers the auto-ignition of the resulting igniter composition, or ii) a composite propellant which lowers the auto-ignition of the resulting igniter composition.

BRIEF DESCRIPTION OF DRAWINGS

The present invention will described in part with reference to the attached drawing which is given by way of a non-limiting example in which the two-part igniter of the present invention is shown schematically in section in an inflator.

BEST MODE FOR CARRYING OUT THE INVENTION

The present invention is directed to a two-part igniter for gas generating compositions. The two-part igniter of the present invention provides particular advantages over known igniters, including an auto-ignition temperature which is well below temperatures at which the mechanical strength of containers housing the two-part igniter and associated gas-generating compositions appreciably deteriorates, and storage stability at ambient temperatures of up to about 110° C. for extended periods up to and beyond ten years. In addition, the two-part igniter of the present invention produces combustion products which are free from toxic, corrosive and flammable components.

The two-part igniter of the present invention comprises a heterogeneous mixture of an ignition material and either a pyrotechnic component or a composite propellant. The pyrotechnic component and the composite propellant used in the present invention are pelletized and in intimate contact with the ignition material which can be either granulated or pelletized.

The two-part igniter of the present invention avoids the use of propellants which are based upon nitrocellulose, e.g., typical gun propellants. While these types of propellants are conventionally utilized in the prior art, the inventor of the present invention has determined that these propellants suffer extensive weight loss at about 107° C. (about 16% after 20 days) which confirms thermal instability at required storage temperatures.

The two-part igniter of the present invention can be utilized to ignite all known gas-generating compositions. In this regard, the two-part igniter of the present invention can be easily incorporated into known inflator devices by merely substituting the two-part igniter for known igniter compositions or igniter systems. It is to be understood that the two-part igniter can be used in conjunction with inflator devices which exclusively utilize combustible gas-generating compositions as well as those which utilize stored, compressed gases.

Although various ignition materials can be used in the two-part igniter of the present invention, the preferred ignition material is a mixture of about 10–30 weight percent boron, about 70–90 weight percent potassium nitrate, and a balance of an optional polymeric binder. The optional polymeric binder, e.g., a polyester, is included when it is desired to pelletize the ignition material. In this regard, it is noted that the ignition material can be used either in a pelletized form or in a granular form. The choice of whether to utilize the ignition material in a granular or pelletized form is based on the application. That is, the form which is more appropriate to gain a desired effect in a particular application, e.g., a particular igniter container during manufacture, can be appropriately chosen as desired. When the ignition material is to be used in a granular form, the optional polymeric binder material is not required nor used. The normal auto-ignition temperature of the ignition material is around 370° C.

In a preferred embodiment, the ignition material includes about 15–25 weight percent boron and about 65–85 weight percent potassium nitrate and optionally about 3–10 weight percent of a conventional polymeric binder. In exemplary embodiments, a granular form of the ignition material was prepared which included about 18 weight percent boron and about 82 weight percent potassium nitrate, and a pelletized form was prepared which included about 24 weight percent boron, about 70 weight percent potassium nitrate and about 6 weight percent of a polyester polymeric binder.

The ignition material is used in conjunction with either a pyrotechnic component or a composite propellant. The pyrotechnic component includes about 60–95 weight percent of an oxidizer, about 2–40 weight percent of a fuel component, and optionally up to about 20 weight percent of a polymeric binder. In a more preferred embodiment the pyrotechnic component includes about 70–80 weight percent of an oxidizer, about 20–25 weight percent of a fuel component, and optionally from about 2–5 weight percent of a polymeric binder.

The pyrotechnic component, as well as the composite propellant, is required to be in a pelletized form for reasons discussed in detail below. Accordingly, the optional polymeric binder is incorporated into the pyrotechnic component in the amount set forth above when necessary to pelletize the pyrotechnic component composition.

The oxidizer used in the pyrotechnic component can be an alkali metal chlorate or combinations and mixtures with alkali metal perchlorates. Preferred oxidizers used in the pyrotechnic component include alkali metal chlorates such as potassium chlorate, sodium chlorate and lithium chlorate. While a single oxidizer is generally utilized, it is within the scope of the present invention to utilize more than one of the discussed oxidizers. The oxidizer should be present in an amount which is at least sufficient to substantially oxidize all the oxidizable species associated with the pyrotechnic component.

The pyrotechnic component includes a fuel component selected from any type of polysaccharide, including mixtures of polysaccharides and their derivatives. Exemplary polysaccharides include dextrins, celluloses, starches, and the like. In addition to polysaccharides, disaccharides such as lactose, but not sucrose, can be used as the fuel component. Monosaccharides such as glucose and fructose are not acceptable, while high-melting hydroxycarboxylic acids and derivatives of these compounds, such as tartaric acid, are acceptable.

As discussed above, the optional polymeric binder used in the pyrotechnic component is provided, when necessary, to enable pelletization of the pyrotechnic component. If the relative amounts of the oxidizer and the fuel component are such that the mixture can be pelletized without the addition of a polymeric binder, the polymeric binder can be omitted. Whether the polymeric binder is required can be easily determined once the types and relative amounts of the oxidizer and the fuel component are selected.

Various optional polymeric binders which can be used in the pyrotechnic component include synthetic resins and synthetic thermoplastic polymers. Exemplary polymeric binders include polybutadiene based polymers such as polyurethanes based on hydroxyterminated polybutadiene (HTPB), copolymers of polybutadiene and acrylonitrile (PBAN) and polyesters based upon carboxyterminated polybutadiene (CTPB). Other preferred polymeric binders include polycarbonate, polyesters in general and epoxies.

The composite propellant which can be used in place of the pyrotechnic component includes about 50–92 weight percent of an oxidizer, about 8–40 weight percent of a polymeric binder, up to about 40 weight percent of a metal fuel component, and about 0.1–5 weight percent of a catalyst. In a more preferred embodiment the composite propellant includes about 68–88 weight percent of an oxidizer, about 8–20 weight percent of a polymeric binder, about 8–30 weight percent of a metal fuel component, and about 0.2–2 weight percent of a catalyst.

The oxidizer used in the composite propellant can be the same as the oxidizer used in the pyrotechnic component. In addition to alkali metal chlorates and alkaline earth metal chlorates, the oxidizer used in the composite propellant can also be selected from alkali metal perchlorates, alkaline earth metal perchlorates, and ammonium perchlorate. Combinations and mixtures of these listed oxidizers can also be utilized. Here, and above, "combination" refers to more than one species in a generic group, e.g., alkali metal perchlorates, and "mixtures" refers to oxidizers selected from more than one generic group. Preferred oxidizers used in the propellant component include perchlorates, such as ammonium perchlorate, potassium perchlorate, sodium perchlorate, and the like.

The polymeric binder used in the composite propellant can be selected from those polymeric binders listed above which can be used in the pyrotechnic component. Preferred polymeric binders used in the composite propellant include polyurethanes base on hydroxyterminated polybutadiene (HTPB), and on copolymers of polybutadiene and acrylonitrile (PBAN), and polyesters based upon carboxyterminated polybutadiene (CTPB).

The metal fuel component used in the composite propellant includes metals such as aluminum, zirconium and magnesium, and the like which are flammable in powdered form. The function of the metal fuel component is to increase the flame temperature and generate hot metal particles for improved ignition.

The catalyst is added to reduce $T_{ig}$ and also to catalytically accelerate combustion. Preferred catalysts include iron oxides, with $Fe_2O_3$ being the most preferred iron oxide. Although $Fe_2O_3$ is the preferred, FeO and $Fe_3O_4$ can also be used. Organometallics such as t-butyl catocene, diferrocenyl ketone, triferrocenyl phosphine oxide, triferrocenyl ethane, and n-hexyl carborane have all been found to markedly reduce the auto-ignition temperature when used as the catalyst in the composite propellant; however, these materials are much more expensive that iron oxides. Other heavy-metal oxides, such as chromates have also been determined to be suitable catalyst.

As discussed above, the ignition material can be either in a granular form or in a pelletized or tablet form. However, the pyrotechnic component and the composite propellant, which ever is used, is required to be in a pelletized form. Moreover, the two-part igniter, i.e., the ignition material and either the pyrotechnic component or the composite propellant, is required to be a heterogeneous mixture with the ignition material and either the pyrotechnic component or the composite propellant in direct or intimate contact with each other.

It has been discovered that there is a critical consolidated mass which the pelletized pyrotechnic component or the composite propellant must have in order to lower the auto-ignition temperature of the two-part igniter. That is, each pellet of the pyrotechnic component or composite propellant must has a minimum weight of about 25 mg. Preferably, the mass of each pellet of the pyrotechnic component or composite propellant is between about 25–100 mg. Pellets which are smaller than about 25 mg, when used singularly, have been found to be ineffective at lowering the auto-ignition temperature of the two-part igniter. Pellets which are greater than 100 mg do not provide any additional advantage, thus the additional material mass is unnecessary.

The two-part igniter was designed to preferably use a single pellet of the pyrotechnic component or the composite propellant. The use of a single pellet has been found to be sufficient to lower the auto-ignition temperature of the two-part igniter. Moreover, the use of a single pellet utilizes a minimum amount of the pyrotechnic component or the composite propellant and can provide advantages in manufacturing inflator devices.

The criticality of the mass of the pyrotechnic component or composite propellant was discovered during the course of the present invention as follows. Initially, homogeneous mixtures of 175 mg of the ignition material in granular form and 25 mg of the pyrotechnic component in a granular form were subjected to controlled auto-ignition. The resulting homogeneous mixture failed to auto-ignite at 260° C. It was then discovered that a heterogeneous mixture of 175 mg of the ignition material in granular form and a single 25 mg pellet of the pyrotechnic component auto-ignited at 186° C. during controlled auto-ignition testing. Subsequently, it was determined that a single pellet having a weight of between about 25–100 mg was sufficient alone to provide the two-part igniter with acceptable auto-ignition temperatures, i.e., between about 150° C. to about 250° C.

It is to be understood that more than one pellet of the pyrotechnic component or the composite propellant can be utilized in the two-part igniter. However, the critical mass of each additional pellet cannot be appreciably reduced. Thus, when more pellets are utilized, a greater total mass of the pyrotechnic component or composite material must also be utilized, without achieving any particular advantage.

While the mass of the pellet of the pyrotechnic component or the composite propellant has been determined to be critical, the pellet is not limited to any particular shape. That is, the pellet can be square, spherical, cylindrical, etc., as desired. In exemplary embodiments cubic pellets having 3 to 4 mm sides were prepared and found to be useful for purposes of the present invention.

In the two-part igniter, the ratio of the ignition material to either the pyrotechnic component or the composite propellant can range from about 1:1 to 20:1, with a ratio of about 3:1 to 12.5:1 being more preferred.

The sole figure schematically depicts a two-part igniter according to the present invention for illustrative purposes. As shown in the figure, the two-part igniter 1 is contained in a metal container 2, e.g., an aluminum container and includes a heterogeneous mixture of an ignition material 3 and a single pellet 4 of a composition which effectively lowers the auto-ignition temperature of the ignition material. The pellet 4 comprises either the pyrotechnic component or the composite propellant which is discussed in detail above. In normal use, the two-part igniter is ignited by initiator 5 which can be a conventional electric squib which is activated upon a sensed condition in a known manner. Once the two-part igniter 1 is ignited, a primary gas-generating material 6 becomes ignited and provides the necessary gas to cause inflatable device 7 to become inflated. It is to be understood that the amount of the primary gas-generating material 6 can be selected to provide either all the gases used to inflate the inflation device 7. Otherwise, the amount of the primary gas-generating material may be selected to merely supplement and heat a supply of a stored, pressurized gas 8, as depicted in the figure. In further embodiments, the ignition material 3 itself can produce gases which are sufficient to supplement and heat a supply of stored, pressurized gas 8.

As discussed above, applicant's two-part igniter can be utilized to ignite all known gas-generating compositions.

Moreover, the two-part igniter of the present invention can be easily incorporated into known inflation devices by merely substituting the two-part igniter for known igniter compositions or igniter systems. Thus, it to be understood that in the sole figure, details of the elements of the inflator and inflation device are not required for a complete understanding of applicant's invention which is directed to the composition of the two-part igniter.

Features and characteristics of the two-part igniter of the present invention will illustrated with reference to the following non-limiting examples which are presented for illustrative purposes only. In the examples and throughout, percentages are by weight unless otherwise stated.

EXAMPLE 1

In this example several two-part igniter compositions were tested to determine their auto-ignition temperatures.

In the two-part igniter compositions of this example, the ignition material was "2C Granules", its state of aggregation was granular, and its composition was 18 percent boron and 82 percent $KNO_3$. The weight ratio of the igniter material to the pyrotechnic component or the composite propellant was 7:1. One cubic pellet of the pyrotechnic component or composite propellant was utilized in a heterogeneous mixture with the granular ignition material. The composition of the pyrotechnic component and the composite propellants are listed in Table I below.

TABLE I

| GENRE | INGREDIENT | SPECIFIC EXAMPLES COMPOSITION, WEIGHT % | AUTOIGNITION TEMPERATURE $T_{ig}$, °C. |
|---|---|---|---|
| Pyrotechnic Component | Oxidizer: Alkali Metal Chlorate | 75 $KClO_3$ | 186 |
| | Fuel: Polysaccharide | 25 Lactose | |
| Composite Propellant | Oxidizer: Ammonium Perchlorate | 69 $NH_4ClO_4$ | 254 |
| | Fuels: Polymeric Binder | 12 HTPB Binder | |
| | Metal | 18 Al | |
| | Catalyst: Iron Oxide | 1 $Fe_2O_3$ | |
| Composite Propellant | | 69 $NH_4ClO_4$<br>12% HTPB Binder<br>19% Aluminum | 346 |

A comparison between the two composite propellants in Table I and the respective auto-ignition temperatures of the resulting two-part igniters demonstrates the importance of the catalyst in reducing the auto-ignition temperature of compositions that do not contain mixtures of metal chlorates and polysaccharides.

EXAMPLE 2

In this example the auto-ignition temperatures of a two-part igniter including a pyrotechnic component and a two-part igniter including a composite propellant were compared. The compositions of the pyrotechnic component and composite propellant are set forth in Table II below. In this example the ignition material was 2C Granules and a single cubic pellet of either the pyrotechnic component or the composite propellant was used. In each case, 700 mg of the ignition material was used with a 100 mg pellet of the respective pyrotechnic component and composite propellant.

TABLE II

| GENRE | INGREDIENT | SPECIFIC EXAMPLES COMPOSITION, WEIGHT % | AUTOIGNITION TEMPERATURE $T_{ig}$, °C. |
|---|---|---|---|
| Pyrotechnic Component | Oxidizer: Alkali Metal Chlorate | 75 $KClO_3$ | 186 |
| | Fuel: Polysaccharide | 25 Lactose | |
| Composite Propellant | Oxidizer: Ammonium Perchlorate | 69 $NH_4ClO_4$ | 247 |
| | Fuels: Polymeric Binder | 12 HTPB Binder | |
| | Metal | 18 Al | |
| | Catalyst: Iron Oxide | 1 $Fe_2O_3$ | |

Although the present invention has been described with reference to particular means, materials and embodiments, from the foregoing description one skilled in the art can easily ascertain the essential characteristics of the present invention and various changes and modifications may be made to adapt the various uses and characteristics without departing from the spirit and scope of the present invention as described by the claims which follow.

What is claimed is:

1. A two-part igniter comprising a heterogeneous combination of:

an ignition material having an auto-ignition temperature, $T'_{ig}$; and a consolidated mass of a component which provides the two-part igniter with an auto-ignition temperature, $T_{ig}$ such that $T_{ig}$ is less than $T'_{ig}$; wherein said component which provides said two-part igniter with an auto-ignition temperature $T_{ig}$ comprises a composite propellant which has a minimum weight of about 25 mg and includes about 50–92 weight percent of an oxidizer, about 8–40 weight percent of a metal fuel component, and about 0.1–5 weight percent of a catalyst, wherein:

said oxidizer is selected from potassium perchlorate, sodium perchlorate, ammonium perchlorate, and mixtures thereof;

said metal fuel component is selected from the group consisting of aluminum, zirconium, magnesium, and mixtures thereof;

said catalyst comprises an iron oxide.

2. A two-part igniter according to claim 1, wherein said composite propellant includes about 68–88 weight percent of an oxidizer, about 8–20 weight percent of a polymer binder, about 8–30 weight percent of a metal fuel component, and about 0.2–2 weight percent of a catalyst.

3. A two-part igniter comprising a heterogeneous combination of:

an ignition material having an auto-ignition temperature, $T'_{ig}$; and a consolidated mass of a component which provides the two-part igniter with an auto-ignition temperature, $T_{ig}$ such that $T_{ig}$ is less than $T'_{ig}$; wherein said component which provides said two-part igniter with an auto-ignition temperature $T_{ig}$ comprises a composite propellant which has a minimum weight of about 25 mg and includes about 50–92 weight percent of an oxidizer, about 8–40 weight percent of a polymeric binder, up to about 40 weight percent of a metal fuel component, and about 0.1–5 weight percent of a catalyst, wherein the oxidizer comprises an alkali or alkaline earth metal chlorate alone or in combination with an alkali metal perchlorate, an alkaline earth metal perchlorate or ammonium perchlorate.

4. A two-part igniter comprising a heterogeneous combination of:

an ignition material having an auto-ignition temperature, $T'_{ig}$; and a consolidated mass of a component which provides the two-part igniter with an auto-ignition temperature, $T_{ig}$ such that $T_{ig}$ is less than $T'_{ig}$; wherein said component which provides said two-part igniter with an auto-ignition temperature $T_{ig}$ comprises a composite propellant which has a minimum weight of about 25 mg and includes about 50–92 weight percent of an oxidizer, about 8–40 weight percent of a polymeric binder, up to about 40 weight percent of a metal fuel component, and about 0.1–5 weight percent of a catalyst, wherein the oxidizer comprises an alkali or alkaline earth metal chlorate and/or an alkali metal perchlorate, an alkaline earth metal perchlorate or ammonium perchlorate.

* * * * *